United States Patent [19]

Porter

[11] 4,336,686

[45] * Jun. 29, 1982

[54] CONSTANT VOLUME, CONTINUOUS EXTERNAL COMBUSTION ROTARY ENGINE WITH PISTON COMPRESSOR AND EXPANDER

[75] Inventor: Kenneth W. Porter, Mercer Island, Wash.

[73] Assignee: Combustion Research & Technology, Inc., Seattle, Wash.

[ * ] Notice: The portion of the term of this patent subsequent to May 29, 1998, has been disclaimed.

[21] Appl. No.: 898,915

[22] Filed: Apr. 21, 1978

[51] Int. Cl.[3] ..... F02G 3/02

[52] U.S. Cl. ..... 60/39.63; 123/44 B; 123/44 E; 123/204

[58] Field of Search ..... 60/39.63; 91/482, 498; 123/44 B, 44 E, 43 C, 204

[56] References Cited

U.S. PATENT DOCUMENTS

| | | | |
|---|---|---|---|
| 410,043 | 8/1889 | Studley et al. | 91/498 X |
| 1,151,855 | 8/1915 | Baumstark | 123/44 B |
| 1,243,494 | 10/1917 | Dunning | 91/482 |
| 1,456,479 | 5/1923 | Atkinson et al. | 123/44 B |
| 1,853,563 | 4/1932 | Hungerford et al. | 123/44 E X |
| 3,104,527 | 9/1963 | Gesell | 60/39.63 |
| 3,254,489 | 6/1966 | Eickmann | 123/204 |
| 3,893,295 | 7/1975 | Airas | 60/39.63 |
| 3,989,011 | 11/1976 | Takahashi | 123/204 |
| 4,072,445 | 2/1978 | Hay | 91/498 X |

*Primary Examiner*—Michael Koczo, Jr.
*Attorney, Agent, or Firm*—Cole, Jensen & Puntigam

[57] ABSTRACT

Constant volume, continuous external combustion rotary engine which incorporates at least one radial piston compressor, at least one continuous-combustion chamber, at least one radial piston expander together with a means to supply fuel to the combustion chamber. A novel arrangement of compressor and expander manifolding controls admission and discharge to and from the compressor and expander sections. Power output is realized when opposed expander pistons equipped with roller bearings react directly on the internal cam lobe surfaces of a stationary housing causing the cylinder block to rotate and drive the compressor piston inwardly or outwardly as their roller followers engage their cam tracks. As a fresh charge of compressed air is delivered to the hydrocarbon fueled combustion chamber, an equal amount of combustion product under almost equal pressure is withdrawn by the expander. When combustion charging is completed, both compressor and expander are momentarily disconnected from the combustion chamber. The isolated combustion process continues, at constant volume, causing a pressure rise until the expander admission valves open again. Mechanical work is produced as the expander pistons are moved outwardly, initially under the almost constant pressure of the combustion chamber and then at a decreasing pressure as the expander pistons continue to expand the combustion product after the expander admission valves have closed. An exhaust discharge stroke commences as the expander piston after completing the expansion stroke, returns inwardly to the inner dead center position. Simultaneously a new charge of ambient air is induced by the compressor as the compressor piston moves outwardly to the outer dead center position, and the cycle repeats as the fresh charge is compressed for discharge to the combustor.

40 Claims, 10 Drawing Figures

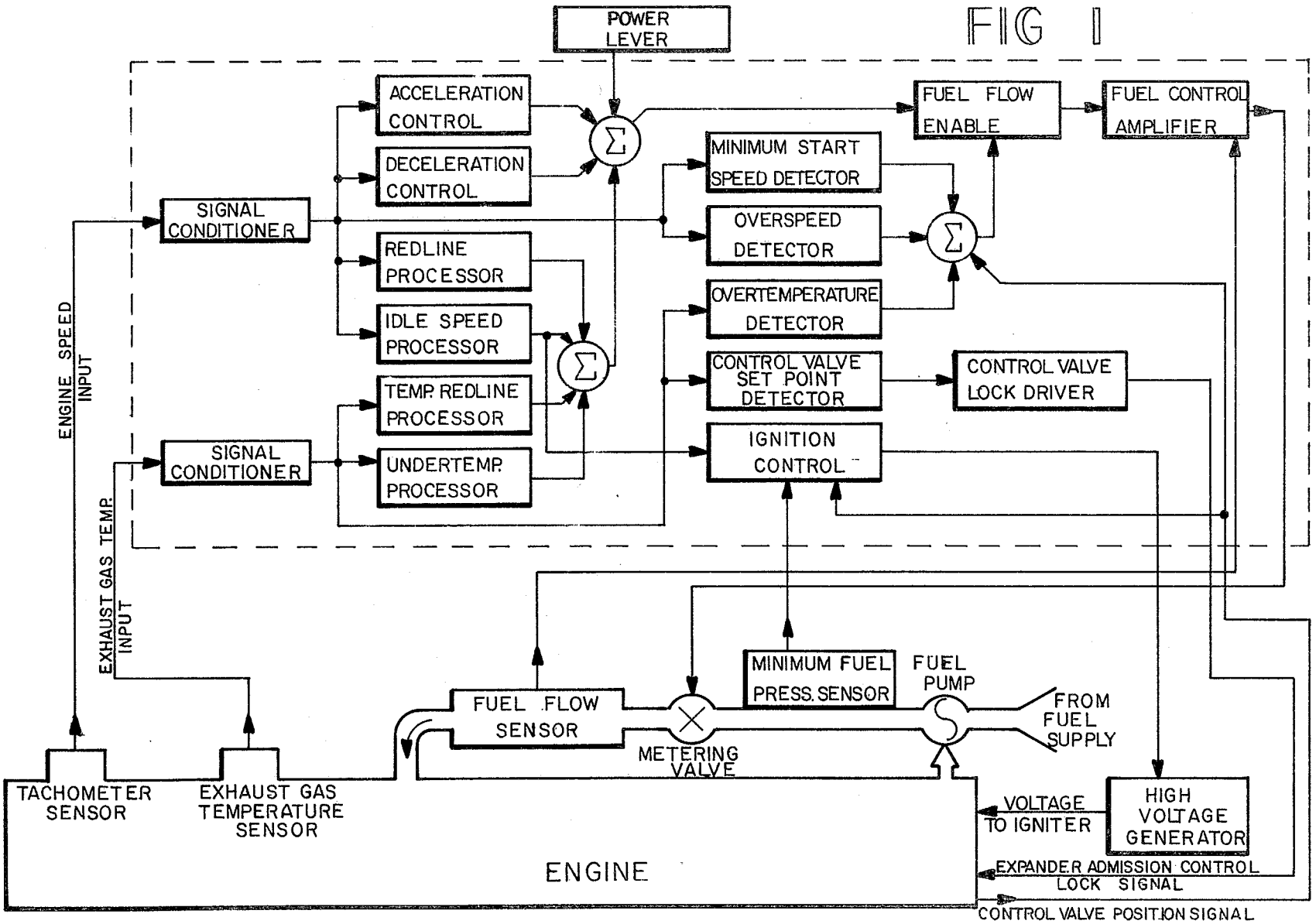
FIG 1
POWER LEVER
ACCELERATION CONTROL
DECELERATION CONTROL
REDLINE PROCESSOR
IDLE SPEED PROCESSOR
TEMP. REDLINE PROCESSOR
UNDERTEMP. PROCESSOR
SIGNAL CONDITIONER
SIGNAL CONDITIONER
MINIMUM START SPEED DETECTOR
OVERSPEED DETECTOR
OVERTEMPERATURE DETECTOR
CONTROL VALVE SET POINT DETECTOR
IGNITION CONTROL
CONTROL VALVE LOCK DRIVER
FUEL FLOW ENABLE
FUEL CONTROL AMPLIFIER
ENGINE SPEED INPUT
EXHAUST GAS TEMP INPUT
TACHOMETER SENSOR
EXHAUST GAS TEMPERATURE SENSOR
FUEL FLOW SENSOR
METERING VALVE
MINIMUM FUEL PRESS. SENSOR
FUEL PUMP
FROM FUEL SUPPLY
VOLTAGE TO IGNITER
HIGH VOLTAGE GENERATOR
EXPANDER ADMISSION CONTROL LOCK SIGNAL
CONTROL VALVE POSITION SIGNAL
ENGINE

CONSTANT VOLUME, CONTINUOUS EXTERNAL COMBUSTION ROTARY ENGINE WITH PISTON COMPRESSOR AND EXPANDER

BACKGROUND OF THE INVENTION

The invention relates generally to the area of gas expansion related engines and more particular to a constant combustion, constant volume rotary engine.

The design of small engines for the automotive industry has been diligently pursued for a century and in spite of many ingenious alternatives offered, the overwhelming majority of automobile engines made are of the four-cycle reciprocating piston variety, as originally proposed by Otto, Lanchester, and Diesel.

Since 1947, gas turbine drives have been often proposed and several vehicles have been demonstrated, ranging from off-highway dump trucks to high-speed passenger cars. None have been commercially viable to the point where volume production could be undertaken at the rates common to the gasoline reciprocating engine or the diesel engine, which is now becoming increasingly competitive.

Rotary engines have been introduced, typified by the Wankel rotating combustion engine, and over half a million engines have been manufactured over the past ten years. Problems of high fuel consumption and exhaust emission remain to be solved, although the engine is attractive from the standpoint of lower bulk and freedom from vibration.

Each type of engine has certain advantages over its competitors, and a desirable goal for a new engine would be to combine the best features of each. Certain attributes result from millions of hours of developmental and service experience under every climate and condition of duty. Other attributes arise from increasing sophistication and discernment of the users. Yet others come from the political and legislative environmental and economical concerns.

As the finiteness of liquid hydrocarbon fuel supplies becomes daily more apparent, the attention of the public to the need for more efficient use of the available supply has been focused and continues to drive the search for newer and better engines.

The following features are sought in general:

- low first cost
- low maintenance cost
- low vibration and noise
- best fuel economy
- low emissions
- low bulk and weight
- fast response
- easy starting Thermodynamic considerations for most efficient use of the liquid fuel linclude:

- highest possible temperature of combustion
- shortest fuel burning time
- completeness of combustion before expansion
- lowest radiation and conductive/convective heat loss to external heat sink
- lowest exhaust gas temperature following from maximum extraction of mechanical work during the expansion process Mechanical considerations for most efficient use of the materials of construction include:

- highest strength/density ratio for minimum material cost

- lowest use of exotic or rare alloying elements
- high internal damping coefficient for parts subject to vibration
- longest fatigue/wear life for parts subject to flexure or abrasion Conventional 2-cycle or 4-cycle reciprocating or rotary engines utilize intermittent or cyclic combustion processes to permit use of extremely high temperatures and pressures over a small portion of the cycle, giving a lower average cycle temperature suitable for low-cost materials such as aluminum or cast iron. The combustion temperature may exceed 3000° F. instantaneously, but the average piston temperature is lower than 500° F. as heat is conducted away by coolants, lubricants, and the incoming charge air.

Gas turbines employ constant volume combustion and continuous burning within a combustion chamber supplied with excess air for cooling the chamber walls and for protection of the turbine nozzle and blading. Extremely high speeds of rotating compressors and turbines, up to 70,000 rpm for small engines, pose a potential hazard and require protective shields in the plane of rotation. The main advantages are very light weight, complete combustion, and freedom from vibration. Disadvantages include slow starting, high fuel consumption unless expensive recuperators are employed, susceptibility to blade erosion and damage, giving degraded performance, and sensitivity to matching compressor flow to turbine capacity without stalling or surging flow in the compressor.

Other investigators have attempted to marry the multi-piston reciprocating engine with high-speed turbines in combinations ranging in form from turbo-charged engines that have been commonly accepted for forty years, to free-piston engines that have been used as the combustor for power turbine output drives. All of these attempts have sought to use the highly efficient but momentary and cyclic operation of the piston-cylinder combustion chamber.

Those knowledgeable in the art understand that to realize the full potential of the internal combustion engines for automotive vehicles, propeller-driven airplanes and stationary applications, a new generation of engines with reduced engine size, increased engine power-to-weight ratios, and decreased full and part-load specific fuel consumption will have to be developed. Such engines will be designed to improve vehicle performance and will ease the logistic problem of providing fuel for the ever-increasing number of engines required. Careful attention will have to be given to both the aerothermodynamics and the mechanical design concepts selected for such engines, coupled with effective value engineering, mantainability, and reliability in order to reduce their manufacturing, operating and maintenance costs.

To achieve such significant improvement in engine performance, it is necessary to provide for basic improvement in aerodynamic and thermodynamic efficiencies. The major parameters which influence performance in Brayton cycle engines are the compressor pressure ratio and expander-inlet gas temperature. Increasing the compressor pressure ratio provides a significant decrease in specific fuel consumption, while increasing expander-inlet gas temperature provides significant increases in specific power. Analysis of a regenerated simple-cycle engine shows that high expander-inlet gas temperature provides a significant increase in specific power. A moderate decrease in specific fuel consumption is also obtained with increasing expander-inlet temperature. At expander inlet gas temperature in the 2200°-2600° F. range, specific fuel consumption is optimized for a recuperated engine at a compressor pressure ratio of about 10:1. Analysis also shows that the part-load specific fuel consumption of such a new generation of engines will also be reduced by up to 50% over the simple cycle versions. Indications are that higher turbine-inlet gas temperature, higher compressor pressure ratio, and lighter-weight, high-effectiveness recuperator technology are required for the future high performance engines.

The building of such engines requires significant advances in existing technology utilization. Expander materials with sufficient strength at the high temperatures encounterd in advanced gas turbine engines are now available but under utilized in automotive applications. Moreover, high compressor pressure ratios which in aerodynamic compression engine are currently obtained only by incorporating a complex and costly number of compressor stages, can be readily achieved in a single stage using a rotary piston compressor. The size and weight of current gas turbine recuperators severly restricts their use in mobile applications. A measure of recuperation can be attained at little extra cost in the new engine described below.

Every study of new engine cycles or configurations indicates the desirability of high pressure ratios and high gas temperatures. A compact, lightweight recuperator is also desirable. Minimizing the number of engine component stages will certainly reduce cost. The ability to efficiently obtain high cycle pressure ratios with a single stage, and the availability of materials, and design and manufacturing techniques which will allow operation at high gas temperatures, are prerequisites for the design of future generations of engines regardless of the thermodynamic cycle utilized. The invention described below easily accomplishes a single-stage pressure ratio of 16:1 in a simple cycle configuration and 10:1 pressure ratio in a recuperated version.

No prior art is known which is material or pertinent to the invention of this application.

SUMMARY OF THE INVENTION

A modified Brayton cycle rotary engine having two banks of radially actuated pistons within a rotor section arranged to utilize one bank of pistons moved sequentially outwardly and inwardly as comprsessors of the working fluid. Compressor and expander manifolding sequentially provides a compressed charge of working fluid to a combustion chamber located within the manifold area on approximately the same longitudinal axis. The combustion chamber is provided with atomized liquid or a gaseous fuel from an injector at a pressure exceeding that of the combustion chamber under all operating conditions. The movement of air or other gas within the chamber is arranged to mix the fuel homogeneously such that an external ignition source may initiate combustion which is thereafter self-sustaining within certain limits of fuel and oxidizer mixture portions. The second bank of pistons is arranged to sequentially receive the products of combustion by the manifolding means. As a result of the expansion force derived from the pressure of the combusted fluid, the pistons are driven radially outwardly against an internal, stationary cam. The expander pistons are equipped with roller bearings which react directly on the internal cam surfaces of the stationary housing, thus causing the cylinder block to rotate and drive the compressor pistons inwardly or outwardly as their roller followers engage the cam tracks. Power is extracted from the rotary cylinder block by gearing means to a main output shaft.

Accordingly, it is among the many features, advantages and objects of the invention to provide a rotary engine prime mover for automobile drive, marine drive, stationary and industrial drives, and for propeller aircraft propulsion. The rotary engine operates on a constant volume, continuous combustion cycle. The pistons of both the compressor section and the expander sections are radially arranged normal to the axis of a cylindrical shaped manifold assembly and combustion chamber. The engine has the ability to burn a wide variety of fuels of the kerosene type. The continuous combustion permits a very lean burn and substantial fuel economy over a wide operating range of speed. The positive compression and expansion cycles eliminates any possibility of surging flow. The engine is fully balanced and vibration free even at low speed rotary motion. The engine by virtue of a compact cam-roller drive system is of relative low weight and bulk as compared to an equivalent reciprocating engine equipped with a crankshaft drive. A single revolution of the engine completes the equivalent of six cycles of a conventional four stroke reciprocating engine. The engine thermodynamic cyle is unique in that it combines elements of the Diesel and Brayton cycles to give pulsating flow characteristic.

The cam drive permits a new freedom in tailoring piston throw versus degree of engine rotation towards the optimum relationship. Piston motions other than sinusoidal are made available. The drive cam may be shaped to allow constant or continuously variable acceleration/deceleration characteristics including dwell periods where desired. Thermodynamic and mass flow characteristics of the engine may be optimized as a result. Separation of the compressor and expander sections permits the choice of optimum materials and sealing/lubrication methods for the two piston regimes. The compressor piston may be non-ferrous, and modest lubrication measures will suffice even at high compression ratios. The combustor and internal manifolds can be made subject to low pressure differentials and thereby use lightweight construction including ceramic materials. The compressor discharge air may be heated by radiation and convertion from the internalexhaust passges providing a heat recuperation to the cycle and reducing fuel consumption. Special materials are available for insulation and for sealing the expander pistons under dry lubrication conditions and air cooling of the cylinder walls may be provided.

The engine of this invention combines the best features of the gas turbine continuous combustion process with certain advantages of the positive displacement piston engines, among which are: The single combustion chamber, situated at the center of the engine, conserves heat, improves efficiency, and limits noise propagation. Fuel supply arrangements are greatly simplified, consisting mainly of a high-pressure fuel pump, lines, a fuel spray nozzle, and a proportional flow controller. Ignition arrangements are required only at light off or to prevent flameout. A constant pressure source of energy provides the same thrust to each cylinder, removing the roughness arising from dissimilar cylinder performance. Adjustment and maintenance features are simpler for a single combustion chamber than for multiple chambers. Symmetry of design and simplicity of construction minimizes labor cost for assembly initial cost and maintenance. Large flow passages for fuel arrangements for a single combustor make the engine more tolerant of fuel contaminants. Use of high-speed rotating components of the gas turbine engine is avoided, providing safer operation for the using public. Combustion with excess oxygen at reduced cycle temperature will reduce noxious exhaust emissions compared with Diesel and Otto cycle engines without requiring costly or inconvenient exhaust emission control devices.

BRIEF DESCRIPTION OF DRAWINGS

FIG. 1 is a functional block diagram of the engine control system;

DESCRIPTION OF PREFERRED EMBODIMENTS

Figure 6:
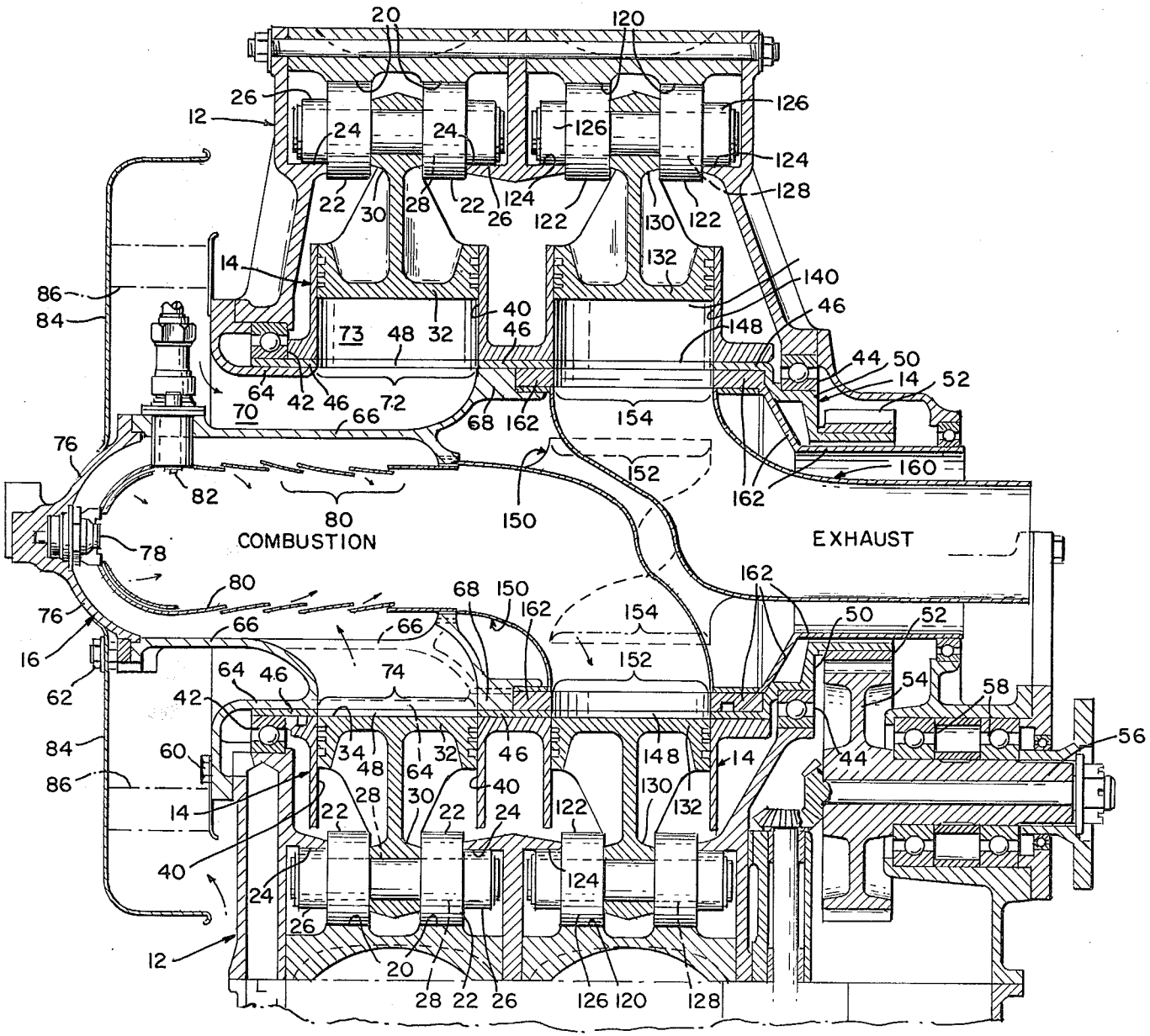
FIG. 6 is a longitudinal cross-section view through the axis of the engine to show specific features of construction and to further illustrate the operating principal thereof in an embodiment having single compressor and expander banks of pistons.

Referring now to FIG. 6, it will be seen that the engine, generally designated by the number 10, includes a stationary housing 12, a rotating cylinder block or rotor 14, and a combustion chamber 16. With reference first to the outer part of the housing or casing 12 it will be noted that internally formed dual cam tracks 20 are provided to form drive cam tracks for the cam follower rollers 22 which comprise the primary means for reacting the outward force on the pistons and thus by reaction force rotating the cylinder block. A dual set of secondary guide cam tracks 24 are provided as can be shown to be engaged by guide cam roller follower 26. A bearing axle 28 is provided on which to mount the drive cam follower rollers 22 and the guide cam follower rollers 26.

Figure 7:
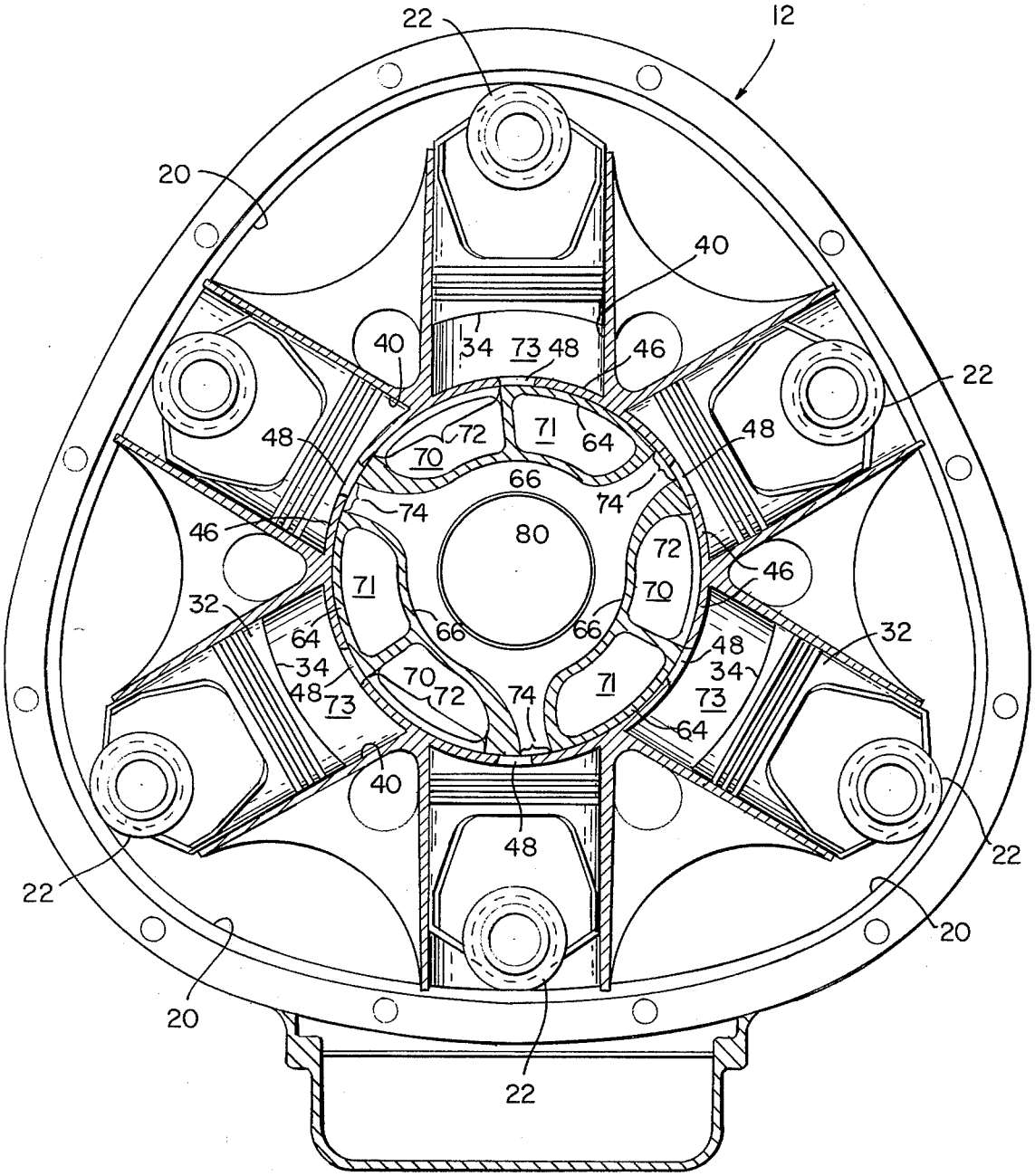
FIG. 7 is a simplified cross-sectional view through the compressor section of the engine.

By reference to FIG. 7, it can be seen that the dual cam surfaces 20 are designed so that for every 120° of rotation the drive cam followers 22 will move from a position at maximum distance from the longitudinal axis of the engine through a position at minimum distance and thence back to a position at maximum distance from the longitudinal axis of the engine. Thus the particular configuration of the engine drive cam track and the piston arrangement illustrated enables the pistons to be moved from what may be considered an outer dead center position to an inner dead center position and thence back to outer dead center position at each 120° of rotation of the cylinder and piston block. The precise curvature of the cam track between inner and outer dead center portions depends upon such load factors as may result from inertia, compression, centrifugal and combined loads. The number of lobes, as can be seen in FIGS. 2, 3, 4 and 5, may vary depending upon the speed, load and duty cycle of the engine required. It should be noted that dwell areas of predetermined constant radius at inner and outer dead center positions may be provided in the cam tracks so that opening and closing the piston chambers is not accompanied by high velocity gas or air through the openings.

A piston connector yoke 30 is mounted on the bearing pin 28 between the spaced apart main drive follower rollers 22 and forms part of the piston body 32 appropriately provided with grooves and piston seal rings and having a piston head surface 34. The rotary piston block 14 is provided with a predetermined number of cylinders 40 within which pistons 32 reciprocate radially inwardly and outwardly as the cylinder block rotates within the stationary cam housing. Bearings 42 and 44 are provided between the stationary outer housing 12 and the rotary cylinder block 14 as shown in FIG. 6. Referring again to FIGS. 6 and 7, it will be noticed that the rotary cylinder block 14 has an interior wall 46 having longitudinally elongated air admission and exit openings 48, the function of which will be described in more detail hereinafter.

At the exhaust end of the engine the rotating cylinder block 14 is radially inwardly offset as at 50 to form a drive gear portion 52. A power takeoff gear 54 is connected to or made a part of power shaft 56 which as can be seen is rotatably received in bearings 58 mounted in turn as a part of the stationary housing 12.

Centrally of the cylindrical interior wall 46 of the rotary cylinder block 14 is the stationary manifold and combustion assembly, generally designated by the number 16. The manifold and combustion assembly 16 bolts onto the outer housing as by bolts 60 and 62. The manifold and combustion assembly is generally cylindrical in shape and has outer wall 64 and generally concentrically and radially inwardly spaced therefrom is an interior wall 66. The compressor portion of the manifold and combustion assembly terminates generally between the compressor and expander sections at an annular sealing or wall section 68. The compressor manifold has three spaced apart and separate air inlet passages 70 as best seen in FIG. 7 between outer wall 64 and inner wall 66 which have peripheral openings 72 for admitting air to be drawn into the piston chamber 73. The openings 72 are of predetermined size to permit a given number of degrees of rotation of the cylinder so that air inlet and exit opening 48 in the head of the cylinder is in registry therewith through a given number degrees of rotation during a cycle. The interior manifold walls 66 are formed to define spaced apart compressed air passages 74 so that they present openings of predetermined rotational width to the inlet/exit openings 48 into the piston chambers. Thus and as shown in FIG. 7 air is admitted to the cylinders through passages 70 and openings 72 and then compressed and released into the combustion area through passages 74.

The manifold and combustion assembly includes combustor cover 76 and further includes a working fluid or fuel injector 78. A closed end cylindrical combustion housing liner 80 is received within the manifold and as can be seen extends from the fuel injector 78 towards the exhaust end of the motor. It contains a number of peripheral openings so that the compressed air as it is ejected from the compressing cylinders is forced through the passages 74 and through the peripheral openings into the interior of the combustion housing where an intimate fuel air mixture is created for combustion. An igniter 82 is provided for starting the engine until self-sustaining combustion takes over. It will be noticed that a shallow pan-like cover 84 is provided in which an annular air filter 86 may be received to define an engine air intake section.

Figure 8:
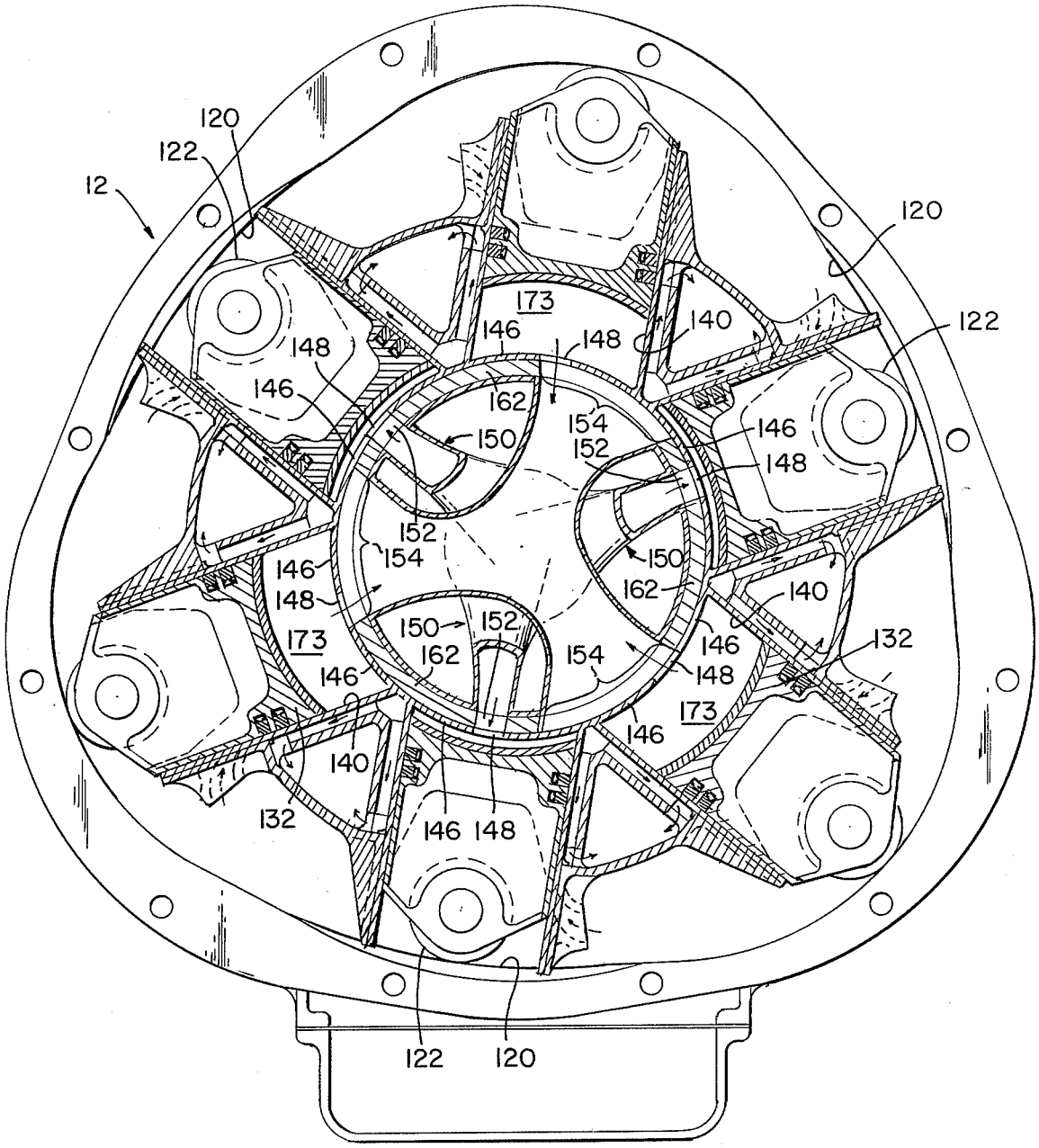
FIG. 8 is a simplified cross-section view of the engine through the expander bank of cylinders.

Referring now to the expander section of the engine, reference being had particularly again in FIGS. 6 and 8, it will be seen that the pistons 132 are received in cylinders 140. The pistons 132 are connected to yokes 130 mounted on bearing pins 128 which in turn also mount cam followers 126 on the guide cam tracks 124 and drive cam track followers 122 which engage the drive cam track 120. The combustion gases are directed from the combustion area via expander manifold passage 152 connected to the combustion housing 80. The expander manifold passages 152 register with openings 148 in the rotating cylinder block for a predetermined time. The expanding gases of combustion are directed to predetermined cylinders for forcing the pistons radially outwardly for the power stroke. As the cylinder block continues to rotate the openings are closed and the pistons are driven outwardly to their outer dead center position. Upon a predetermined number of degrees of rotation, the openings 148 in the cylinder blocks register with exhaust openings 154 in the expander manifold so that the expanded gases may upon the return stroke of the piston exhaust through the exhaust manifold 160. A cylindrical expander admission valve 162 is provided, which is rotatable through a predetermined number of degrees and is controlled by means attached at the outlet side of the engine. The purpose of valve 162 is to block the openings 148 during the exhaust stroke to allow a pressure build-up in the compressor section when the engine is starting and to permit variable expansion characteristics while the engine is running. When pressures within the engines are at a workable level the valve is rotated to unblock the openings 148 and the engines goes into its normal operation.

Figure 2:
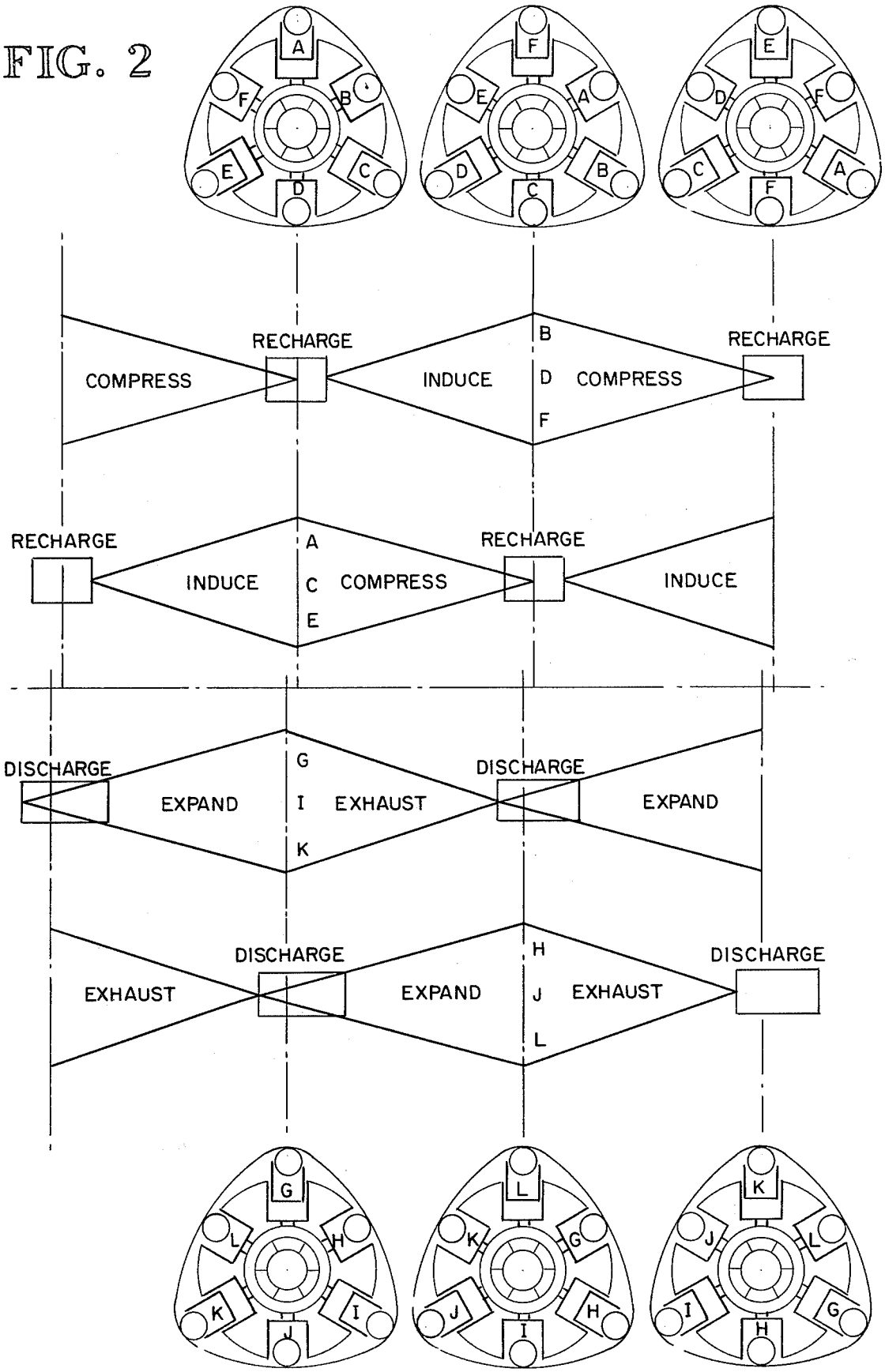
FIG. 2 is a cycle sequence and timing diagram including schematic representations of the compressor and expander sections and the positions of the various cylinders during or at various points in the cycle.
Figure 3:
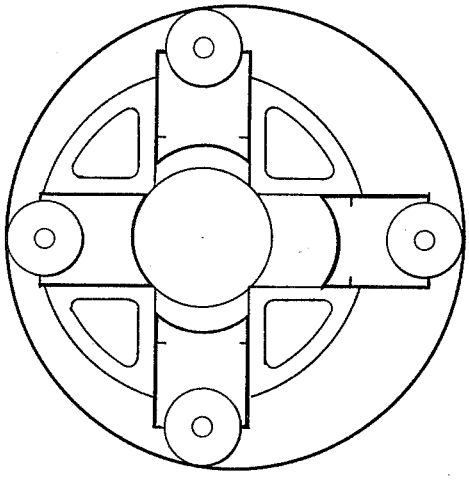
FIGS. 3, 4 and 5 show that engine can be designed to use single, double or triple lobe cam track embodiments.
Figure 4:
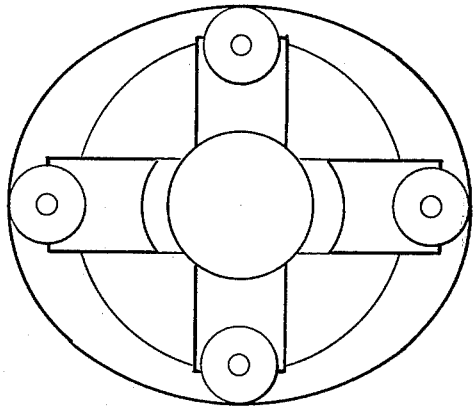
Figure 5:
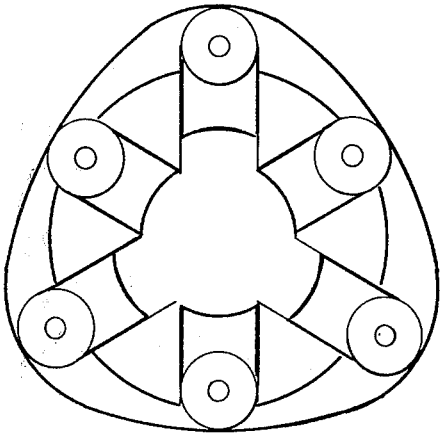

FIG. 2 is a diagrammatic representation of the engine sequence and timing cycle for both the compressor and expander sections. For instance, cylinders designated as A, C, and E at 60° of rotation are at a position at which they have received a full charge of air. As noted, the A, C and E pistons are fully extended or at outer dead center. Upon rotating 60°, pistons A, C and E have been moved radially inwardly back to inner dead center to compress the air charge. Upon reaching full inward movement or inner dead center the rotating cylinder block registers openings 48 of pistons A, C and E with openings 74 in the compression manifold and the compressed air is released into the combustion chamber area. The cylinders block continues to rotate and the pistons A, C and E have moved again to outer dead center and have been recharged with air. Pistons B, D and F simultaneously are compressing when pistons A, C and E are recharging.

As can be seen in the expander section, pistons G, I and K, are radially outwardly extended to outer dead center after an expansion stroke. Upon 60° of rotation to inner dead center, the spent combustion gases have been exhausted and cylinders G, I and K are ready to receive another charge of gas for the outwardly expansion stroke. Finally at 180°, G, I and K have completed their outward expansion stroke and are ready to move back to top dead center to exhaust the spent gases. Note that the timing of the compressor and expander sections is approximately 5° different so that the expander valves open prior to the compressor valve in order that combustion pressure will not be greater than the compressor pressure when the compressor valve opens.

FIG. 1 is included to show that the engine operation is controlled basically by three parameters, that is by engine speed, combustion chamber temperature and operator demand. The electronic control system senses the engine speed by means of an electromagnetic sensor mounted in close proxomity to a gear on the engine output shaft such that it senses the passing of the gear teeth. Combustion chamber temperature may be sensed directly. However, for convenience and durability in this embodiment, it is monitored by extrapolation upward from the exhaust gas temperature which is sensed with a thermocouple junction near the outlet of the engine expander section. Operator demand is sensed by means of a transducer which is stimulated by operator actuation of a conventional accelerator pedal.

The electronic control system utilizes these inputs to generate an electrical stimulus to a metering valve which controls the flow of fuel to the engine. Fuel flow is monitored by means of a flow sensor which is downstream of the metering valve and its output signal is used as a fuel control feedback to the control system. The electronic control provides activation and drive signals to a conventional capacitive-discharge ignition system which, via an ignition coil, drives the igniter in the engine combustion chamber. The ignition system is on when fuel pressures is above a minimum set point, as for example, when engine speed is greater than 375 RPM and exhaust gas temperature is less than 500° F. Internal adjustments to the electronic control system permit the setting of idle speed, maximum possible redline speed, minimum fuel flow, maximum fuel flow, acceleration rate and deceleration rate. The electronic control system provides automatic shutdown when the engine speed exceeds a safe limit, nominally 200 RPM over redline speed, or when the exhaust gas temperature exceeds a safe limit which may be nominally 200° F. over temperature redline. Automatic restart capability is provided when the engine returns to within the safe operating limits. The electronic control system provides fuel flow governing to maintain the engine operation within the safe limits of speed and temperature.

Figure 9:
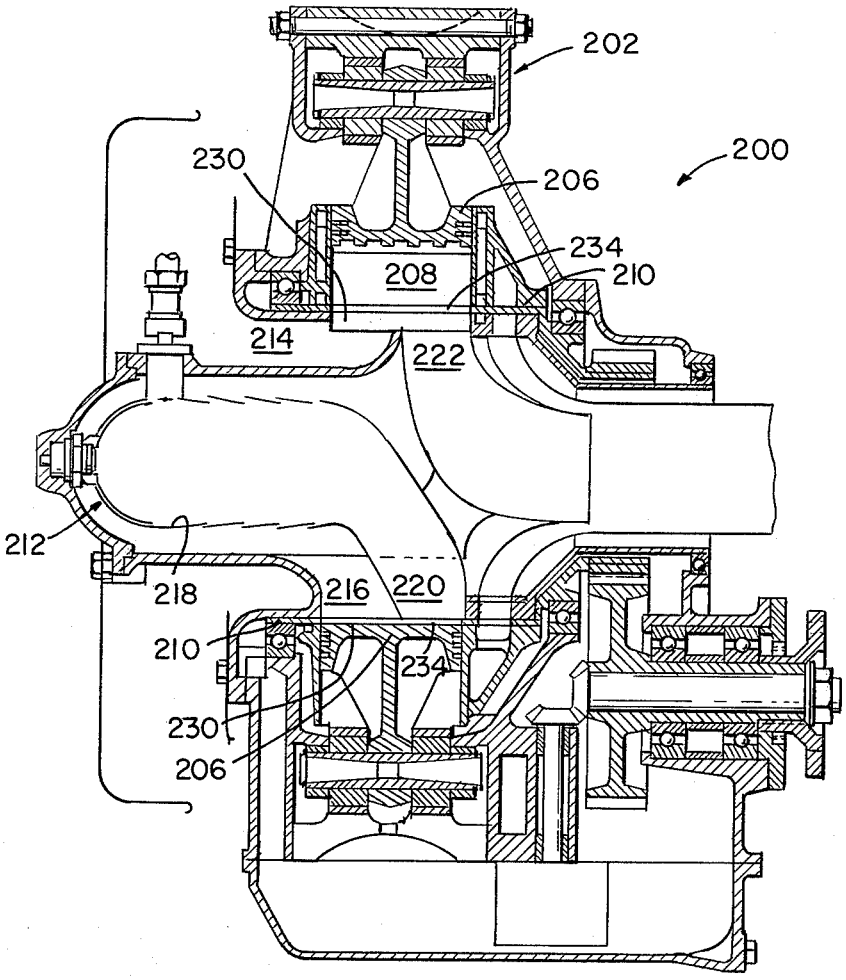
FIG. 9 shows an alternative embodiment with a single bank of pistons which act as both compressor and expander.

It will be seen by reference to FIG. 9 that the single bank of pistons embodiment engine, generally designated by the number 200, has housing 202 with the cam tracks as described above. In addition, the rotary cylinder block 204 is provided with a single bank of radial pistons 206 defining piston chambers 208. A cylindrical interior wall 210 is provided on the rotary block. The compressor and combustion manifold assembly, generally designated by the number 212, includes air inlet passages 214 and compressed air outlet passages 216. A central and generally concentric combustion housing 218 wih a predetermined number of openings is provided on the interior of the manifold assembly for directing compressed air from the pistons into the combustion chamber. In like manner, combustion gas passages 220 and exhaust passages 222 are provided in the compressor and combustion assembly so that it can be seen the manifolding assembly is similar to that described above. It will be appreciated, however, that since a single bank of pistons 206 are functioning both as compressor and expander that air inlet and compressed air openings 230 are located in wall 210 for registering with the manifold passages at predetermined degrees of rotation. In like manner, expansion gas inlet and exhaust gas openings 234 are arranged in the interior wall 210 to accommodate the cycling of the engine as the cylinder block rotates and to be opened to the appropriate compressor or expander passages in the manifold assembly. Also, it will be appreciated that the various openings are not only peripherally spaced apart but that those openings 230 for the compressor part of the cycle are axially spaced from the expander openings 234 for the engine. Accordingly, a piston will function alternatively as a compressor and then as an expander approximately every 60° of rotation of the cylinder block in a three lobe cam embodiment.

Figure 10:
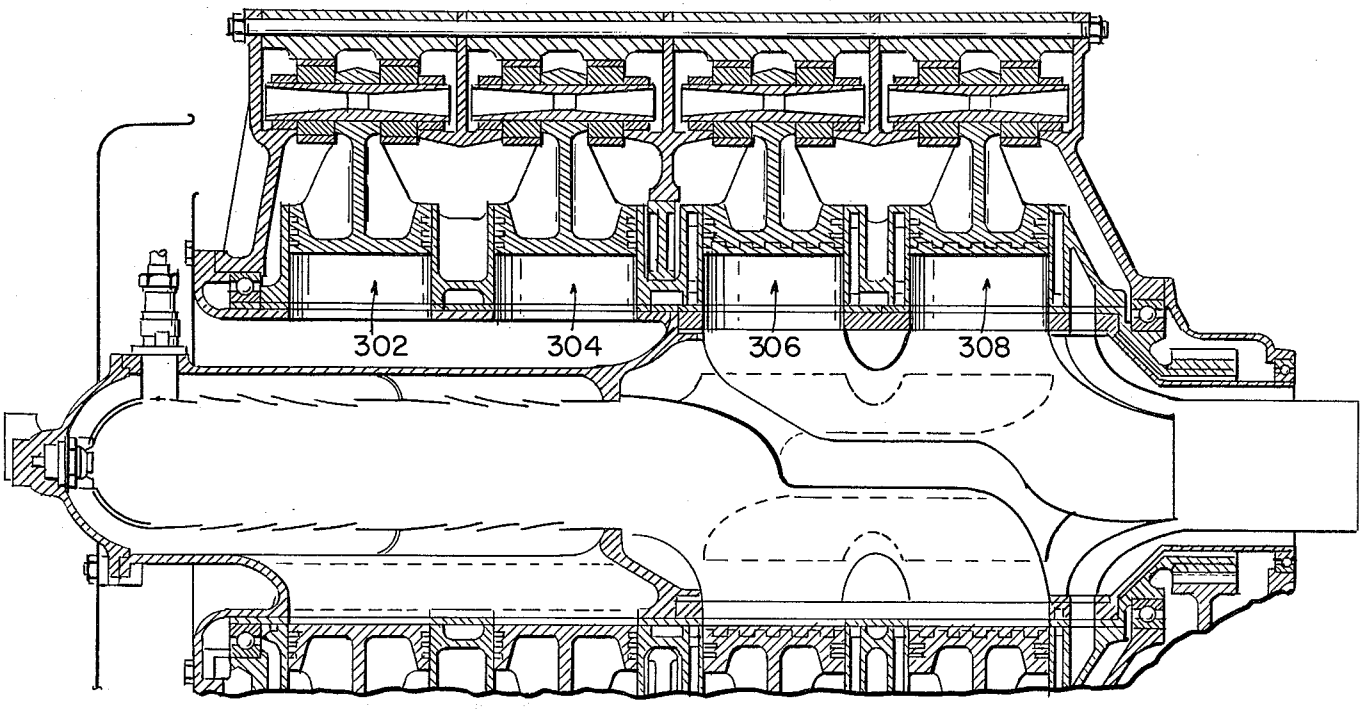
FIG. 10 shows an alternative embodiment with double banks of pistons in the compressor and expander sections.

Finally in FIG. 10 it will be seen that as stated above, an engine embodiment 300 may have dual radial compressor banks 302 and 304 and dual expander piston banks 306 and 308. It will be appreciated that if desired one bank of compressor pistons may be combined with two banks of expander pistons or that there could be provided two banks of compressor pistons with a single bank of expander pistons. It will also be appreciated that by cylinders interconnecting the discharge ports of the respective compressor in the first bank with the intake parts of the next succeeding bank of compressor cylinders using internal manifold means the compression may be achieved successively in stages permitting thermodynamic and bulk/weight advantages whereby the second or succeeding bank of cylinders may be reduced in diametrical dimensions.

In a like manner, the expansion cylinder discharge ports may be connected to the entry ports of the next succeeding bank of expander pistons to permit expansion successively in stages and gain a further thermoynamic advantage. It will be appreciated that the first stage of expander cylinders may be reduced in diametrical dimensions proportionate to the last stage of compressor cylinders.

What is claimed is:

1. Constant volume, continuous external combustion rotary engine, comprising:

(a) an external housing including stationary continuous internal generally symmetrical drive cam track which is generally shaped to define lobes to effect alternate movement of a piston to at least two of an outer dead center and to two of an inner dead center position at predetermined degrees, (b) a rotatable cylinder block within said housing containing (1) at least one bank of radially disposed cylinders numbering at least two defining a compressor section and at least one bank of radially disposed cylinders numbering at least two to define an expander section, (2) said cylinder block further including pistons within said cylinders for reciprocating radial movement and said pistons having connector sections with cam follower means thereon for engaging said drive cam track means, (3) said cylinder block also including a generally cylindrical inner wall enclosing said cylinders to define a cylinder cavity within each cylinder, said inner wall also including opening means of predetermined size, shape and location for each cylinder for the selective intake and release of air and gases, said rotatable cylinder block having a power output means connected thereto, (c) a stationary manifolding and combustion assembly within said cylinder block inner wall, including (1) a compressor portion having air inlet passage and opening means for directing air to at least one first cylinder in said compressor bank at given degrees of rotation of the block and also having compressed air passages and openings for directing compressed air away from said first cylinders at given degrees of rotation of the block, said assembly also including (2) a fuel combustion chamber within said manifolding and combustion assembly for receiving said compressed air and further including fuel igniter and fuel injection means for continuous combustion of the air and fuel mixture within said combustion chamber, (3) an expander portion including hot gas passage and opening means for directing hot gases to said second cylinders in said expander bank during predetermined degrees of rotation of said block and also having exhaust opening and passages for exiting expanded and spent gases away from said second cylinder and out of said engine.

2. The rotary engine according to claim 1 and in which a sleeve type admission valve is provided in the expander section for the purpose of controllably opening and closing said opening in said cylindrical inner wall.

3. The rotary engine according to claim 2 and in which said drive cam track means includes two generally equispaced lobes for effecting alternate outer and inner dead center positions for said pistons.

4. The rotary engine according to claim 3 and in which said rotatable cylinder block includes at least one bank of first radially disposed cylinders defining a compressor section and at least one bank of second radially disposed cylinders axially spaced from said first cylinders defining an expander section.

5. The rotary engine according to claim 4 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

6. The rotary engine according to claim 5 and in which said compressor and expander drive cam track sections each have dual cam tracks for engagement by dual roller followers mounted on said piston connector sections.

7. The rotary engine according to claim 6 and in which said compressor and expander cam track sections are also provided with guide cam track sections in opposed relationship to said drive cam track sections for engagement by rotatable guide cam follower rollers mounted on the same axis as said main cam follower means.

8. The rotary engine according to claim 7 and in which said main and guide rotary cam follower means and said piston connector sections are mounted on a common main pin.

9. The rotary engine according to claim 2 and in which said drive cam track means includes three generally equispaced lobes for effecting alternate outer and inner dead center positions for said pistons.

10. The rotary engine according to claim 9 and in which said rotatable cylinder block includes at least one bank of first radially disposed cylinders defining a compressor section and at least one bank of second radially disposed cylinders axially spaced from said first cylinders defining an expander section.

11. The rotary engine according to claim 10 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

12. The rotary engine according to claim 11 and in which said compressor and expander drive cam track sections each have dual cam tracks for engagement by dual roller followers mounted on said piston connector sections.

13. The rotary engine according to claim 12 and in which said compressor and expander cam track sections are also provided with guide cam track sections in opposed relationship to said drive cam track sections for engagement by rotatable guide cam follower rollers mounted on the same axis as said main cam follower means.

14. The rotary engine according to claim 13 and in which said main and guide rotary cam follower means and said piston connector sections are mounted on a common main pin.

15. The rotary engine according to claim 2 and in which said rotatable cylinder block includes at least one bank of first radially disposed cylinders defining a compressor section and at least one bank of second radially disposed cylinders axially spaced from said first cylinders defining an expander section.

16. The rotary engine according to claim 2 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

17. The rotary engine according to claim 2 and in which said compressor and expander drive cam track sections each have dual cam tracks for engagement by dual roller followers mounted on said piston connector sections.

18. The rotary engine according to claim 2 and in which said compressor and expander cam track sections are also provided with guide cam track sections in opposed relationship to said drive cam track sections for engagement by rotatable guide cam follower rollers mounted on the same axis as said main cam follower means.

19. The rotary engine according to claim 2 and in which said main and guide rotary cam follower means and said piston connector sections are mounted on a common main pin.

20. Constant volume, continuous external combustion rotary engine, comprising:

(a) an external housing including at least two stationary continuous internal, axially spaced apart drive cam track sections, one of which is a compressor cam track and the other of which is an expander cam track, said cam track sections including lobe means shaped to effect alternate movement of a piston from an outer dead center to an inner dead center position at least every 180° of rotation of a rotatable cylinder block supported in said housing, (b) a rotatable cylinder block within said housing containing at least (1) a first bank of at least two radially disposed cylinders defining a compressor section and a second bank of at least two radially disposed cylinders axially spaced from said first bank defining an expander section, (2) said cylinder block further including pistons within said cylinders for reciprocating radial movement and said pistons having connector sections with cam follower means thereon for engaging the drive cam track sections of their respective compressor and expander cam tracks, (3) said cylinder block also including a generally cylindrical inner wall enclosing said cylinders to define a cylinder cavity within each cylinder, said inner wall also including inlet and exit opening means of predetermined size and shape for each cylinder, (c) a stationary manifolding and combustion assembly within said cylinder block inner wall, including (1) a compressor portion having air inlet passage and opening means for directing air to given cylinders of said compressor portion at given degrees of rotation of the block and also having (2) compressed air passages and openings for directing compressed air away from said cylinders at given degrees of rotation of the block, said assembly also including (3) a fuel combustion chamber within said manifolding and combustion assembly for receiving said compressed air and further including fuel igniter and fuel injection means for continuous combustion of the air and fuel mixture within said combustion chamber, (4) an expander portion including hot gas passage and opening means for directing hot gases to given cylinders of said expander portion during predetermined degrees of rotation of said block and also having (5) exhaust openings and passages for exiting expanded and spent gases away from said expander section cylinders and out of said engine.

21. The rotary engine according to claim 20 and in which a sleeve type admission valve is provided in the expander section for the purpose of controllably opening and closing said opening in said cylindrical inner wall.

22. The rotary engine according to claim 21 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

23. The rotary engine according to claim 22 and in which said compressor and expander drive cam track sections each have dual cam tracks for engagement by dual roller followers mounted on said piston connector sections.

24. The rotary engine according to claim 23 and in which said compressor and expander cam track sections are also provided with guide cam track sections in opposed relationship to said drive cam track sections for engagement by rotatable guide cam follower rollers mounted on the same axis as said main cam follower means.

25. The rotary engine according to claim 24 and in which said main and guide rotary cam follower means and said piston connector sections are mounted on a common main pin.

26. The rotary engine according to claim 21 and in which said drive cam track means includes two generally equispaced lobes for effecting alternate outer and inner dead center positions for said pistons.

27. The rotary engine according to claim 26 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

28. The rotary engine according to claim 27 and in which said compressor and expander drive cam track sections each have dual cam tracks for engagement by dual roller followers mounted on said piston connector sections.

29. The rotary engine according to claim 28 and in which said compressor and expander cam track sections are also provided with guide cam track sections in opposed relationship to said drive cam track sections for engagement by rotatable guide cam follower rollers mounted on the same axis as said main cam follower means.

30. The rotary engine according to claim 29 and in which said main and guide rotary cam follower means and said piston connector sections are mounted on a common main pin.

31. The rotary engine according to claim 21 and in which said drive cam track means includes three generally equispaced lobes for effecting alternate outer and inner dead center positions for said pistons.

32. The rotary engine according to claim 31 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

33. The rotary engine according to claim 32 and in which said compressor and expander drive cam track sections each have dual cam tracks for engagement by dual roller followers mounted on said piston connector sections.

34. The rotary engine according to claim 33 and in which said compressor and expander cam track sections are also provided with guide cam track sections in opposed relationship to said drive cam track sections for engagement by rotatable guide cam follower rollers mounted on the same axis as said main cam follower means.

35. The rotary engine according to claim 34 and in which said main and guide rotary cam follower means and said piston connector sections are mounted on a common main pin.

36. The rotary engine according to claim 21 and in which said rotatable cylinder block includes at least one bank of first radially disposed cylinders defining a compressor section and at least one bank of second radially disposed cylinders axially spaced from said first cylinders defining an expander section.

37. The rotary engine according to claim 21 and in which said fuel combustion chamber is defined by a generally cylindrical combustion housing within said manifolding and combustion assembly having a plurality of peripheral openings for admission of compressed air into said chamber, said combustion chamber being located generally in the center area of said rotary engine.

38. The rotary engine according to claim 21 and in which said compressor and expander drive cam track sections each have dual cam tracks for engagement by dual roller followers mounted on said piston connector sections.

39. The rotary engine according to claim 21 and in which said compressor and expander cam track sections are also provided with guide cam track sections in opposed relationship to said drive cam track sections for engagement by rotatable guide cam follower rollers mounted on the same axis as said main cam follower means.

40. The rotary engine according to claim 21 and in which said main and guide rotary cam follower means and said piston connector sections are mounted on a common main pin.

* * * * *